US007613418B2

(12) United States Patent
Matayoshi

(10) Patent No.: US 7,613,418 B2
(45) Date of Patent: Nov. 3, 2009

(54) IMAGE FORMING APPARATUS

(75) Inventor: Akira Matayoshi, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 12/129,016

(22) Filed: May 29, 2008

(65) Prior Publication Data

US 2008/0304878 A1 Dec. 11, 2008

(30) Foreign Application Priority Data

Jun. 8, 2007 (JP) ..... 2007-152881

(51) Int. Cl.
*G03G 15/01* (2006.01)

(52) U.S. Cl. ..... 399/298; 399/308

(58) Field of Classification Search ..... 399/298
See application file for complete search history.

(56) References Cited

U.S. PATENT DOCUMENTS 6,385,427 B1 * 5/2002 Nakane ..... 399/303
7,254,359 B2 8/2007 Iwakura et al.
2005/0185991 A1 * 8/2005 Iwakura et al. ..... 399/299

FOREIGN PATENT DOCUMENTS

JP 2001-282014 10/2001
JP 2005-24936 1/2005
JP 2005-234229 9/2005

* cited by examiner

*Primary Examiner*—David M Gray
*Assistant Examiner*—Roy Yi
(74) *Attorney, Agent, or Firm*—Gerald E. Hespos; Anthony J. Casella

(57) ABSTRACT

An image forming apparatus (10) includes image bearing members (20) having respective peripheral surfaces and arranged sequentially so that toner images of toners having different colors are formed on the peripheral surfaces, respectively, an endless belt (30) having a surface and so rotated that the toner images are sequentially transferred to the surface or a sheet (P) conveyed on the surface, transferring members (40) for transferring the toner images to the surface of the endless belt (30) or the sheet (P). The downstream-most image bearing member (20) from which the toner image is last transferred to the surface of the endless belt (30) or the sheet (P) is arranged so that a contact pressure of the downstream-most image bearing member (20) against the endless belt (30) becomes higher than contact pressures of the other image bearing members (20) against the endless belt (30).

8 Claims, 5 Drawing Sheets

EXAMPLE

COMPARATIVE EXAMPLE

IMAGE FORMING APPARATUS

BACKGROUND OF THE INVENTION

1. Field of the Invention

The present invention relates to an image forming apparatus capable of performing a color printing. More particularly, it relates to an image forming apparatus which is so configured as to transfer toner images, which are formed on a plurality of photosensitive drums corresponding to respective colors, sequentially to an image transferred member such as an intermediate transferring belt in superimposition to form a color image, and then transfer the color image to a sheet.

2. Description of the Related Art

A so-called tandem (in-line) type image forming apparatus capable of performing a color printing includes a plurality of photosensitive drums (image bearing members) which are sequentially arranged so as to correspond to toners of respective colors (generally, four kinds of toners including cyan, magenta, yellow and black), and an intermediate transferring belt so provided as to come in contact with peripheral surfaces of the photosensitive drums. Toner images formed respectively on the peripheral surfaces of the photosensitive drums are transferred to the intermediate transferring belt in superimposition while the intermediate transferring belt is rotated. This allows a color image to be formed on a surface of the intermediate transferring belt (primary transfer). The color image formed on the intermediate transferring belt is transferred to a sheet (secondary transfer). The sheet on which the color image is printed by the secondary transfer is discharged to outside after a predetermined fixing processing is applied.

Each of the photosensitive drums faces a respective transferring roller through the intermediate transferring belt. An electric charge having a polarity opposite to a polarity of the toner image is applied to the intermediate transferring belt through the transferring roller. Accordingly, the toner image formed on the photosensitive drum is electrically peeled off and transferred onto the intermediate transferring belt.

Meanwhile, since a photosensitive drum for black toners is provided on a downstream-most side in a rotational direction of the intermediate transferring belt, the black toners are generally superimposed onto the intermediate transferring belt after toners of other colors are superimposed. As described above, since the black toners are superimposed on the color toners on the intermediate transferring belt, the black toners are layered directly on the sheet with toners of other colors superimposed on the black toner layer when the color image is transferred from the intermediate transferring belt to the sheet. Such superimposition of toners of respective colors achieves a favorable image quality of the color image.

Further, in the case where a monochromatic printing using only black toners is performed in a color image forming apparatus, and if a photosensitive drum for black toners is arranged on an upstream side of the intermediate transferring belt, it is necessary that a transfer position on the intermediate transferring belt where the black toners are transferred move a long distance to reach a sheet positioned at a downstream-most side of the intermediate transferring belt. Therefore, a time necessary for performing a first printing to the sheet becomes disadvantageously long. For the purpose of dealing with such disadvantage (in other words, for the purpose of speeding up the first printing), the photosensitive drum for black toners is provided on the downstream-most side of the intermediate transferring belt.

Japanese Laid-open Patent Publication No. 2005-234229 (hereinafter, referred to as patent document 1) discloses a measure, which is applied to a tandem type image forming apparatus, for improving a transfer efficiency of toners transferred from photosensitive drums to an intermediate transferring belt. According to this measure, nip pressures (a pressure which can be acquired by coming in press contact with each other) between the photosensitive drums and the corresponding transferring rollers at the time of the primary transfer can be changed, and the nip pressure on an upstream-most side of the intermediate transferring belt in a rotational direction is set to be maximum whereas the other nip pressures are lowered sequentially towards the downstream side (refer to the paragraph [0067] and FIG. 7 of the patent document 1). It is disclosed that making the nip pressures be lowered sequentially towards the downstream-most side of the intermediate transferring belt in the rotational direction prevents aggregation of toners so that the transfer efficiency improves.

Further, Japanese Laid-open Patent Publication No. 2001-282014 (hereinafter, referred to as patent document 2) and Japanese Laid-open Patent Publication No. 2005-024936 (hereinafter, referred to as patent document 3) disclose measures, which are applied to a tandem type image forming apparatus, for preventing the center omission of a transferred image (an image is transferred in such a manner that its center portion becomes pale and is omitted while edges of the transferred image are clear). According to the measures, a nip pressure of a photosensitive drum (in particular, a photosensitive drum for black toners and provided on a downstream-most side of the intermediate transferring belt) which is likely to cause the center omission is set to be lower than nip pressures of other photosensitive drums. It is disclosed that the center omission which is thought to be caused by toners squeezed out from the center towards the edges of the image due to a high nip pressure can be prevented effectively.

However, in the tandem type image forming apparatus capable of performing a color printing, a factor greatly affecting the toner transfer efficiency and the center omission is not only nip pressures between the photosensitive drums and the intermediate transferring belt but also the surface hardness of the intermediate transferring belt, the difference in linear speed between the peripheral surfaces of the photosensitive drums and the surface of the intermediate transferring belt, the peripheral surface characteristics of the photosensitive drums, the surface characteristics of the intermediate transferring belt, and the characteristics of toners. Thus, in relation to the transfer of toners from the photosensitive drums to the intermediate transferring belt, it is not meaningful to focus on nip pressures between the photosensitive drums and the intermediate transferring belt for prevention of the center omission.

On the other hand, in relation to the transfer quality of toners transferred from the photosensitive drums to the intermediate transferring belt, another factor other than the transfer efficiency and the center omission may be important, such as a so-called "toner dispersion" which causes toner particles to be dispersed around in the periphery of the intermediate transferring belt at the time of transfer so that the surface of the intermediate transferring belt is contaminated with the dispersed toner particles to render the outlines of letters, characters, images, etc printed on the sheet. It is assumed that this toner dispersion occurs since fine toner particles attached to the peripheral surface of the photosensitive drum and having an electric charge of a predetermined polarity are dispersed due to a shock given at the time when the toners are electrically peeled off by a bias of an inversed polarity applied by the transferring roller and are transferred to the surface of the intermediate transferring belt.

Such toner dispersion is not mentioned in the patent documents 1-3. Thus, there is no description regarding a measure taken for eliminating the toner dispersion.

SUMMARY OF THE INVENTION

The present invention was made in view of such conventional situation, and its object is to provide an image forming apparatus so configured as to prevent the toner dispersion of toners transferred from the image bearing members to the transferring belt.

For the purpose of achieving the object, an image forming apparatus in accordance with the present invention includes a plurality of image bearing members having respective peripheral surfaces and arranged sequentially so that toner images of toners having different colors are formed on the peripheral surfaces, respectively, an endless belt having a surface and so rotated that the toner images formed on the image bearing members are sequentially transferred to the surface or a sheet conveyed on the surface, a plurality of transferring members for sandwiching the endless belt with the corresponding image bearing members to transfer the toner images formed on the image bearing members to the surface of the endless belt or the sheet. The image bearing member on the downstream-most side among the plurality of image bearing members and from which the toner image is last transferred to the surface of the endless belt or the sheet is so arranged that a contact pressure of the downstream-most side image bearing member against the endless belt becomes higher than contact pressures of the other image bearing members against the endless belt.

These and other objects, features and advantages of the present invention will become more apparent upon reading of the following detailed description along with the accompanied drawings.

BRIEF DESCRIPTION OF THE DRAWINGS

FIG. 2A is an exploded perspective view, and FIG. 2B is an assembled perspective view.

FIG. 3A shows a positional relationship between those components for magenta, cyan and yellow units, and FIG. 3B shows a positional relationship between those components for a black unit.

FIG. 5A shows the example, and FIG. 5B shows the comparative example.

DETAILED DESCRIPTION OF THE PREFERRED EMBODIMENTS

Figure 1:
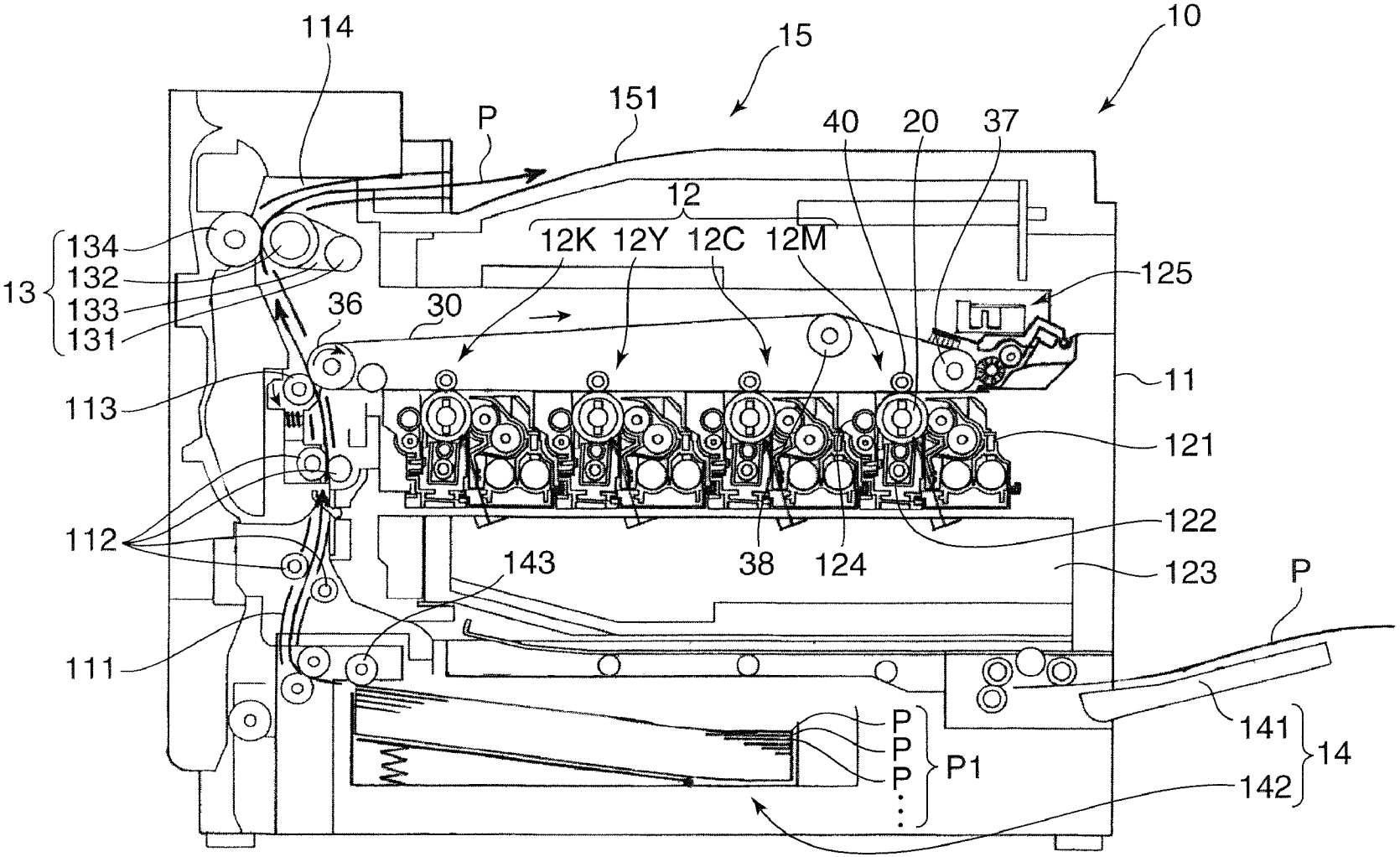
FIG. 1 is a front cross-sectional view showing an internal structure of an image forming apparatus in accordance with an embodiment of the present invention.

FIG. 1 is a front cross-sectional view showing an internal structure of an image forming apparatus in accordance with an embodiment of the present invention. As shown in FIG. 1, an image forming apparatus 10 in accordance with the present embodiment is used as a printer exclusive for printing. In a box-shaped apparatus main body 11 of the image forming apparatus 10, there are provided an image forming section 12 for forming an image in accordance with image information transmitted from an external equipment such as a computer, a fixing section 13 for fixing the image which is formed by the image forming section 12 and transferred onto a sheet P, and a sheet storage section 14 for storing the sheet P onto which the image is to be transferred. Further, a sheet discharging section 15, onto which the sheet P applied with the fixing processing is discharged, is formed on the top of the apparatus main body 11.

At an appropriate position on an upper surface of the apparatus main body 11, there is provided an unillustrated operation panel for inputting output conditions of the sheet P. The operation panel is provided with a power key, a start button, and various keys for inputting the output conditions, all of those are not illustrated.

The image forming section 12 is adapted to form a toner image on the sheet P fed from the sheet storage section 14. In the present embodiment, the image forming section 12 includes a magenta unit 12M using magenta toners (developer), a cyan unit 12C using cyan toners, a yellow unit 12Y using yellow toners and a black unit 12K using black toners, and all of the units are sequentially provided from an upstream side (on a right side of the sheet of FIG. 1) to a downstream side.

Each of the units 12M, 12C, 12Y and 12K includes a photosensitive drum (image bearing member) 20 and a developing device 121. The photosensitive drum 20 is adapted to form on its peripheral surface an electrostatic latent image and a toner image (visible image) based on the electrostatic latent image. The photosensitive drum 20 rotates in a counterclockwise direction in FIG. 1 and receives supply of toners from the corresponding developing device 121. The developing device 121 receives supply of toners from an unillustrated toner cartridge provided on a front surface side (a front side of the sheet of FIG. 1) of the apparatus main body 11.

In the present embodiment, a so-called two-component developer including toners and carriers is adopted. The toners are fine powders which are made by dispersing additive agents such as a coloring agent, an electric charge control agent and a wax in a binder resin, and each toner particle has a particle diameter of 6-12 μm. On the other hand, the carriers are magnetic particles such as a magnetite ($Fe_3O_4$) each having a particle diameter of 60-200 μm and are used for charging the toners. The toners are consumable supplies which are supplied appropriately from the unillustrated toner cartridge to the developing device 121. On the other hand, a predetermined amount of the carriers are stored in the developing device 121, and they are generally used in a circulated manner without being consumed.

At a position directly under each photosensitive drums 20, there is provided a charging device 122, respectively. At a position under the charging device 122, there is provided an exposure device 123. The peripheral surface of the photosensitive drum 20 is charged uniformly by the charging device 122. A laser light corresponding to a respective color based on image data inputted from a computer and the like is irradiated to the peripheral surface of the photosensitive drum 20 charged by the corresponding exposure device 123, so that an electrostatic latent image is formed on the peripheral surface of the photosensitive drum 20. The toners are supplied from the developing device 121 to the electrostatic latent image, so that a toner image is formed on the peripheral surface of the photosensitive drum 20.

At a position directly over the photosensitive drums 20, there is provided an intermediate transferring belt (endless belt) 30. The intermediate transferring belt 30 is tensioned between a driving roller 36 provided on the left side in FIG. 1 and a driven roller 37 provided on the right side in FIG. 1, and a forward belt (belt on a lower side) which brings out the function described above comes in contact with the peripheral surfaces of the photosensitive drums 20. The intermediate transferring belt 30 rotates around the driving roller 36 and the driven roller 37 in synchronization with the photosensitive drums 20 in such a state of being pressed onto the peripheral surfaces of the photosensitive drums 20 by primary transferring rollers (transferring members) 40 provided correspondingly to the photosensitive drums 20.

Further, in the present embodiment, a tension roller 38 is provided at a position between the driving roller 36 and the driven roller 37 and closer to the driven roller 37. The tension roller 38 gives a tensional force to the intermediate transferring belt 30, and is urged upward by a biasing force exerted by an unillustrated biasing member. Thus, a backward belt corresponding to an upper side of the intermediate transferring belt 30 (belt on a side which is in contact with the tension roller while not being in contact with the photosensitive drum 20) is pushed upward by the tension roller 38. Accordingly, the intermediate transferring belt 30 has a mountain-like shape having a peak at a portion supported by the tension roller 38.

By rotation of the intermediate transferring belt 30, a toner image of magenta toners is transferred to the surface of the intermediate transferring belt 30 by the photosensitive drum 20 of the magenta unit 12M. Next, a toner image of cyan toners is transferred in superimposition to the same transfer position on the intermediate transferring belt 30 by the photosensitive drum 20 of the cyan unit 12C. Next, a toner image of yellow toners is transferred in superimposition to the same transfer position on the intermediate transferring belt 30 by the photosensitive drum 20 of the yellow unit 12Y. Finally, a toner image of black toners is transferred in superimposition by the photosensitive drum 20 of the black unit 12K. Accordingly, a color toner image is formed on the surface of the intermediate transferring belt 30. The color toner image formed on the surface of the intermediate transferring belt 30 is transferred to the sheet P which is conveyed from the sheet storage section 14.

Further, on a left side position of each photosensitive drum 20 in FIG. 1, a drum cleaning device 124 is provided for removing toners remaining on the peripheral surface of the photosensitive drum 20 to clean the surface. The peripheral surface of the photosensitive drum 20 cleaned by the drum cleaning device 124 moves to the charging device 122 for new charging processing.

Waste toners removed from the peripheral surface of the photosensitive drum 20 by the drum cleaning device 124 pass through a predetermined passage so as to be collected into an unillustrated toner collection bottle.

On a left side position of the image forming section 12 in FIG. 1, a sheet conveying passage 111 extending in a vertical direction is formed. The sheet conveying passage 111 is provided with a pair of conveying rollers 112 at appropriate positions. The sheet P from the sheet storage section 14 is conveyed by driving of the pair of conveying rollers 112 to the intermediate transferring belt 30 wound around the driving roller 36. On the sheet conveying passage 111, there is provided a secondary transferring roller 113 which comes in contact with the surface of the intermediate transferring belt 30 at a position facing the driving roller 36. The sheet P to be conveyed on the sheet conveying passage 111 is pressed and sandwiched by the intermediate transferring belt 30 and the secondary transferring roller 113, so that the toner image on the intermediate transferring belt 30 is transferred to the sheet P.

The fixing section 13 is adapted to perform a fixing processing to the toner image transferred on the sheet P in the image forming section 12, and includes a heating roller 131 having an electric heating member as a heat source, a fixing roller 132 arranged on a left side in FIG. 1 so as to face the heating roller 131, a fixing belt 133 extending between the fixing roller 132 and the heating roller 131, and a pressing roller 134 arranged so as to face the fixing roller 132 through the fixing belt 133.

The sheet P supplied to the fixing section 13 in a state where the toner image on the intermediate transferring belt 30 is transferred to the sheet P by passing of the sheet P through a nip between the intermediate transferring belt 30 and the secondary transferring roller 113 acquires heat from the fixing belt 133 while passing through the pressing roller 134 and the high-temperature fixing belt 133, so that the fixing processing is applied to the toner image on the sheet P.

The sheet P applied with the fixing processing and completed with a color printing passes through a sheet-discharging conveying passage 114 extending from an upper portion of the fixing section 13 to be discharged to a sheet-discharging tray 151 of the sheet-discharging section 15 provided on top of the apparatus main body 11.

The sheet storage section 14 includes a manual feeding tray 141 provided openably and closably in a right side wall of the apparatus main body 11 in FIG. 1 and a sheet tray 142 dismountably mounted under the exposure device 123 in the apparatus main body 11. The sheet tray 142 stores a sheet stack including a plurality of stacked sheets.

The manual feeding tray 141 is adapted to feed the sheets P to the image forming section 12 one after another by a manual operation. The manual feeding tray 141 is normally accommodated in the right wall surface of the apparatus main body 11, but it is pulled out from the wall surface as shown in FIG. 1 only when feeding the sheets by the manual operation.

The sheet tray 142 is a box-like container having an open upper side and is capable of storing a sheet stack P1 including a plurality of stacked sheets P. An uppermost sheet P of the sheet stack P1 stored in the sheet tray 142 is conveyed from the sheet stack P1 to the sheet conveying passage 111 by driving of a pickup roller 143 in a state where a downstream end (left end in FIG. 1) of an upper surface of the sheet P comes in contact with the pickup roller 143. The sheets P conveyed one after another from the sheet tray 142 pass through the sheet conveying passage 111 by driving of the pair of conveying rollers 112 and then move to the nip between the secondary transferring roller 113 and the intermediate transferring belt 30 in the image forming section 12.

In the present embodiment, a belt cleaning device 125 for removing toners remaining on the backward belt of the intermediate transferring belt 30 applied with the secondary transfer (transferring the color image on the forward belt of the intermediate transferring belt 30 to the sheet P at the nip between the intermediate transferring belt 30 and the secondary transferring roller 113 at a position of the driving roller 36) is provided at a position corresponding to the driven roller 37.

Figure 2A:
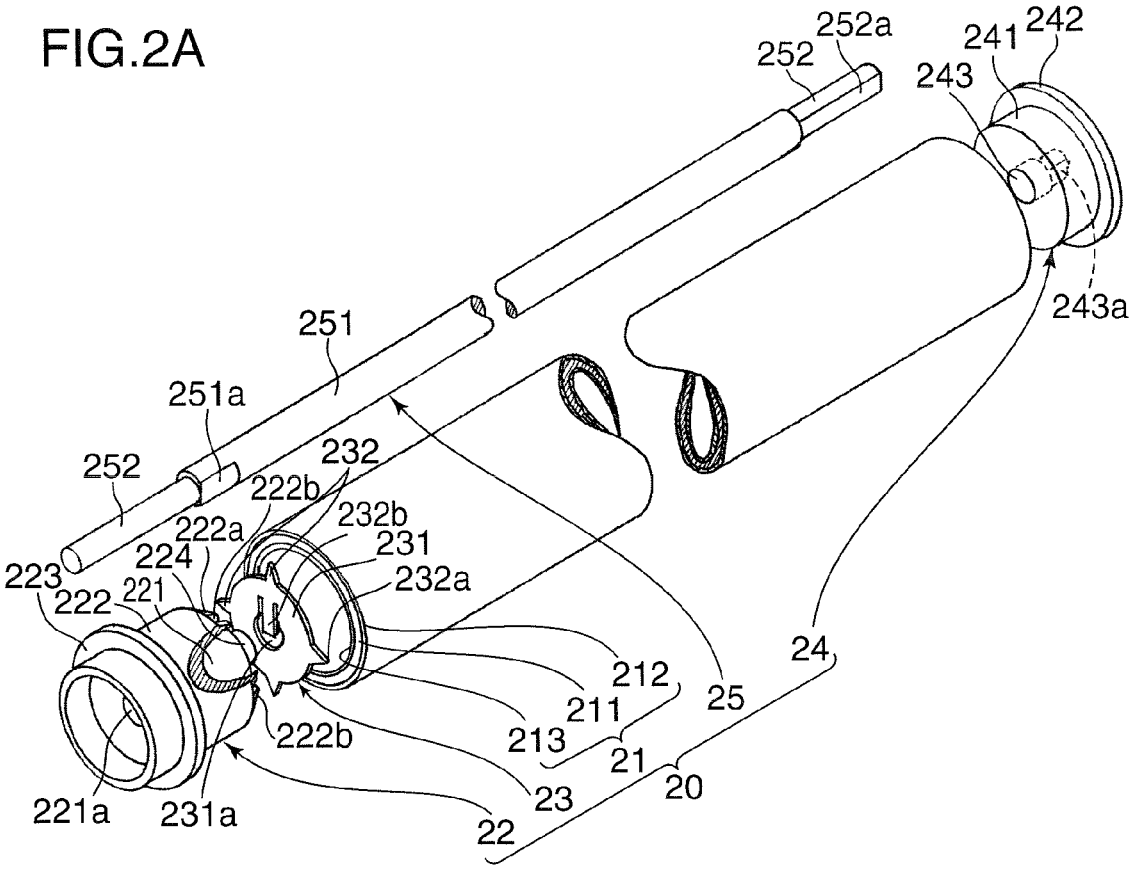
FIGS. 2A and 2B show perspective views of a photosensitive drum of the image forming apparatus in accordance with the embodiment.
Figure 2B:
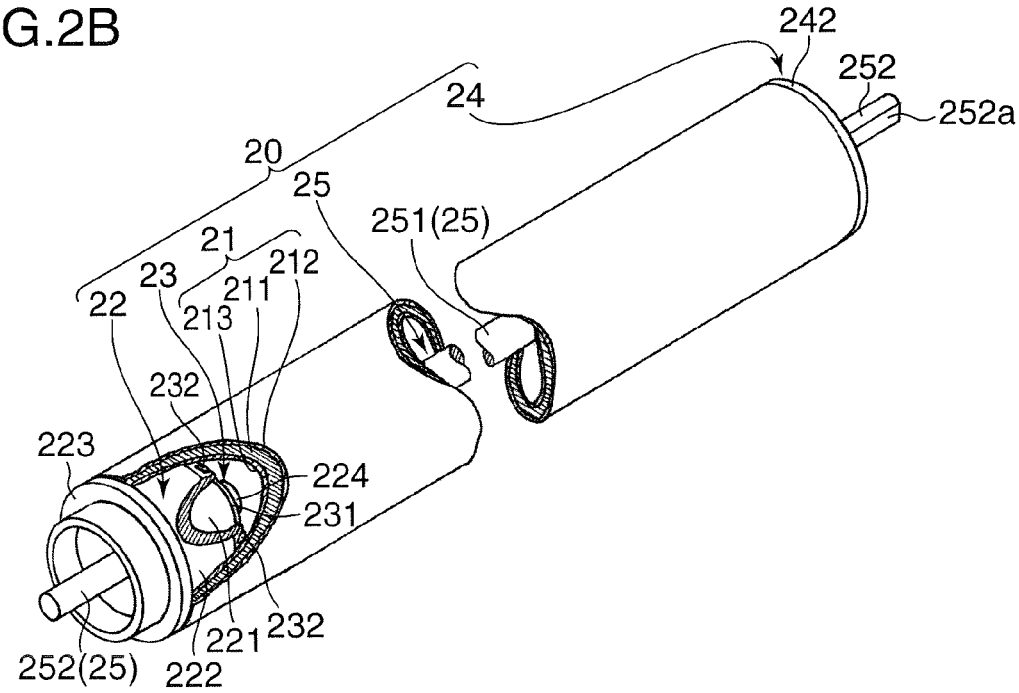

FIGS. 2A and 2B are perspective views showing an embodiment of the photosensitive drum 20. FIG. 2A is an exploded perspective view, and FIG. 2B is an assembled perspective view. As shown in FIGS. 2A and 2B, the photosensitive drum 20 includes a drum main body 21 having a cylindrical shape so that an electrostatic latent image and a toner image are formed on its peripheral surface, a flange member 22 fitted into an opening on one end side (left end side in the example shown in FIGS. 2A and 2B) of the drum main body 21, an earth plate 23 mounted to the flange member 22, a shaft-supporting circular plate 24 mounted to the other end side of the drum main body 21, and a drum shaft 25 passing through the flange member 22 and the shaft-supporting circular plate 24 coaxially and integrally rotatably.

The drum main body 21 includes a metal tube 211 made of aluminum or aluminum alloy, an organic photosensitive layer 212 which is layered on a whole outer peripheral surface of the metal tube 211, and an electrically insulative coating 213 which is layered on a whole inner peripheral surface of the metal tube 211. In the present embodiment, the drum main body 21 has an outer diameter of 24 mm-30 mm. Further, the metal tube 211 has a thickness of several mm, and on the other hand each of the organic photosensitive layer 212 and the electrically insulative coating 213 has an extremely small thickness of several μm to dozens of μm.

The organic photosensitive layer 212 includes organic photosensitive materials such as a charge transport agent, a charge generating agent and a binder resin. Since an organic photosensitive member can be manufactured easier and having a wider variety of alternative photosensitive materials as compared to a conventional inorganic photosensitive member, it is advantageous in having a high degree of freedom in structural designing. There are mainly two types of organic photosensitive member: a single-layer photosensitive member and a multi-layer photosensitive member. It is preferable to use a single-layer photosensitive member since it can be used for any of positively or negatively charged photosensitive members, has a simple structure to be easily manufactured, can suppress a lack of coating at a time of forming a photosensitive member layer, and has a small surface boundary to easily improve an optical characteristic.

The electrically insulative coating 213 is adapted to prevent occurrence of black spots on the image due to occurrence of a fine discharge break-down (leakage) caused by a current flowing to the electrically insulative coating 213, or to prevent rusting.

In the present embodiment, the electrically insulative coating 213 is formed of an oxidized coating of aluminum ($Al_2O_3$). The electrically insulative coating 213 can be obtained by applying an anodic oxidization processing to the inner peripheral side of the metal tube 211 with use of water solution of oxalic acid, sulfuric acid, or chromic acid as an electrolyte.

The flange member 22 includes an inner cylindrical body 221, an outer cylindrical body 222 fitted freely and coaxially to the inner cylindrical body 221 while having a circular clearance therebetween, and a flange 223 formed coaxially with the outer cylindrical body 222 at a position relatively close to one end side (left end side in the example shown in FIG. 2) of the outer cylindrical body 222. At a center position of the inner cylindrical body 221, there is formed a shaft hole 221*a* for allowing the drum shaft 25 to pass through. Between an outer peripheral surface of the inner cylindrical body 221 and an inner peripheral surface of the outer cylindrical body 222, there is provided a circular wall, so that the inner cylindrical body 221 and the outer cylindrical body 222 are integrated.

Further, on an end face of the flange member 22 in an insertion direction toward the drum main body 21 (right side surface in FIG. 2), there is provided an earth plate mounting cylinder 224 projecting rightward coaxially with the flange member 22. The earth plate 23 is externally fitted to the earth plate mounting cylinder 224 to be mounted to the flange member 22.

An outer diameter of the outer cylindrical body 222 is set to be slightly smaller than an inner diameter of the metal tube 221 on which the electrically insulative coating 213 is formed. Accordingly, the outer cylindrical body 222 can be slided into the drum main body 21.

The outer cylindrical body 222 has a circular slope portion 222*a* on its end portion (right end portion in FIG. 2) which is to be inserted to the drum main body 21. The circular slope portion 222*a* is so formed that its outer diameter becomes smaller gradually toward the insertion direction. The circular slope portion 222*a* has notched recesses 222*b* formed by notching the circular slope portion 222*a* at four portions with a pitch of 90 degrees center angles from a leading end of the outer cylindrical body 222 along the axis direction of the outer cylindrical body 222. The notched recesses 222*b* are used for fitting claw-like connection pieces 232 of the earth plate 23, which will be described hereinafter.

The earth plate 23 is made of metal material such as stainless steel or brass having elasticity. The earth plate 23 is inserted into the drum main body 21 for electrical connection with the metal tube 211.

The earth plate 23 includes a circular earth-plate main body 231 having an outer diameter generally equal to that of the inner cylindrical body 221 and four claw-like connection pieces 232 projecting from a peripheral edge of the earth-plate main body 231 radially outward at equal pitches.

The earth-plate main body 231 has an insertion hole 231*a* at its center position for inserting the drum shaft 25 coaxially. Thus, the earth plate 23 is mounted to the flange member 22 by inserting the earth plate mounting cylinder 224 into the insertion hole 231*a*.

Further, the earth-plate main body 231 has a connection piece 232*b* projecting from the periphery of the insertion hole 231*a* toward a center of the insertion hole 231*a*. The connection piece 232*b* is elastically deformed in a state where the earth plate 23 is externally fitted to a large-diameter shaft 251 of the drum shaft 25, and comes in press-contact with the peripheral surface of the large-diameter shaft 251. Accordingly, an electrical connection between the earth plate 23 and the drum shaft 25 can be secured.

The claw-like connection piece 232 is adapted to achieve an electrical connection with the metal tube 211 for earthing in a state where the earth plate 23 is mounted to the drum main body 21. In the present embodiment, the claw-like connection piece 232 is formed to have an isosceles triangle having a base which is in connection position with the metal tube 211. On a leading end side of the claw-like connection piece 232, a sharp-pointed end 232*a* is formed which can cut off (i.e., scratch off and scrape off) the electrically insulative coating 213 on the inner peripheral surface of the drum main body 21. In the present embodiment, there are four claw-like connection pieces 232 provided at pitches of 90 degrees in a peripheral direction of the earth-plate main body 231.

The amount of projection of such claw-like connection piece 232 from the earth-plate main body 231 is so set that the sharp-pointed end 232*a* interferes with the inner peripheral surface of the drum main body 21 and cuts off the electrically insulative coating 213 to reach the metal tube 211 when the flange member 22 is inserted into the drum main body 21.

The shaft-supporting circular plate 24 is adapted to close an opening of the drum main body 21 on an end face which is opposite to the end face to which the flange member 22 is mounted. The shaft-supporting circular plate 24 has a cylindrical circular-plate main body 241 having an outer diameter slightly greater than an inner diameter of the drum main body 21, and a flange 242 which is formed coaxially with the circular-plate main body 241 on one end (right end in the example shown in FIG. 2) of the circular-plate main body 241. The flange 242 has an outer diameter which is equal to that of the drum main body 21.

At a center position of the shaft-supporting circular plate 24, a shaft hole 243 is formed through which the drum shaft 25 passes. The shaft hole 243 has a key portion 243*a* which is a hole having a D-shape cross section and formed by cutting off a part of an arc surface thereof so as to be flat.

An outer diameter of the circular-plate main body 241 of the shaft-supporting circular plate 24 is set to be several μm to dozens of μm larger than an inner diameter of the drum main body 21. Thus, by pressing the circular-plate main body 241 into the drum main body 21, the shaft-supporting circular plate 24 is fixed to the drum main body 21.

The drum shaft 25 is mounted integrally and rotatably inside the drum main body 21 with its axis aligned on the axis of the drum main body 21 and has a large-diameter shaft 251 and a pair of small-diameter shafts 252 projecting coaxially in opposite directions to each other from opposite ends of the large-diameter shaft 251.

On a left end portion of the large-diameter shaft 251 in FIGS. 2A and 2B, a D-cut surface 251*a* is formed. On the other hand, at a part of an inner peripheral surface of the flange member 22, there is provided an unillustrated key portion which comes in surface contact with the D-cut surface 251*a*. The D-cut surface 251*a* and the key portion come in contact with each other in a state where the large-diameter shaft 251 is fitted into the flange member 22, so that the drum shaft 25 and the flange member 22 are rotated integrally.

Further, in the right small-diameter shaft 252 on the right side in FIG. 2A, a D-cut surface 252*a* is formed which associates with the key portion 243*a* formed in the shaft hole 243 of the shaft-supporting circular plate 24. The D-cut surface 252*a* of the right small-diameter shaft 252 in FIG. 2A comes in contact with the key portion 243*a* of the circular-plate main body 241, so that the drum shaft 25 and the shaft-supporting circular plate 24 become integrally rotatable.

When the drum shaft 25 is inserted into the flange member 22 to which the earth plate 23 is mounted and into the drum main body 21 to which the shaft-supporting circular plate 24 is mounted, the connection piece 232*b* of the earth plate 23 comes in press-contact with the peripheral surface of the large-diameter shaft 251. Accordingly, electrical connection between the drum shaft 25 and the earth plate 23 is secured.

The right small-diameter shaft 252 in FIG. 2A receives a drive force from an unillustrated drive motor provided at an appropriate portion in the apparatus main body 11 through a predetermined gear mechanism, so that the photosensitive drum 20 is integrally rotated about the drum shaft 25.

Further, the left small-diameter shaft 252 in FIG. 2A is supported on a predetermined earthed frame provided at an appropriate portion in the apparatus main body 11 through a bearing. Thus, an electric charge generated in the organic photosensitive layer 212 is earthed through the sharp-pointed end 232*a* of the claw-like connection piece 232 of the earth plate 23, the earth-plate main body 231, the connection piece 232*b*, the large-diameter shaft 251, the small-diameter shaft 252, and the frame of the apparatus main body 11.

The intermediate transferring belt 30 is sandwiched between the photosensitive drum 20 having the above configuration and the primary transferring roller 40 provided above the photosensitive drum 20, and is rotated in the clockwise direction in FIG. 1 between the driving roller 36 and the driven roller 37.

The peripheral surface of the primary transferring roller 40 is in contact with an upper surface of the forward belt of the intermediate transferring belt 30, and the primary transferring roller 40 applies a bias, having a polarity opposite to that of the electric charge of the toner image, to the intermediate transferring belt 30. Accordingly, the toner image formed on the surface of the organic photosensitive layer 212 of the drum main body 21 is electrically peeled off from the organic photosensitive layer 212 and transferred to the surface (lower surface) of the intermediate transferring belt 30.

When the toner image is transferred from the peripheral surface of the photosensitive drum 20 to the surface of the intermediate transferring belt 30, a so-called toner dispersion may occur which causes fine particles of toners to disperse around in the intermediate transferring belt 30 and adhere to the surface of the intermediate transferring belt 30 around the toner image.

In the present embodiment, a relative positional relationship between the photosensitive drum 20, the intermediate transferring belt 30 and the primary transferring roller 40, and a contact pressure of the peripheral surface of the photosensitive drum 20 with respect to the surface of the intermediate transferring belt 30 are set appropriately, so that the toner dispersion is prevented from occurring.

Figure 3A:
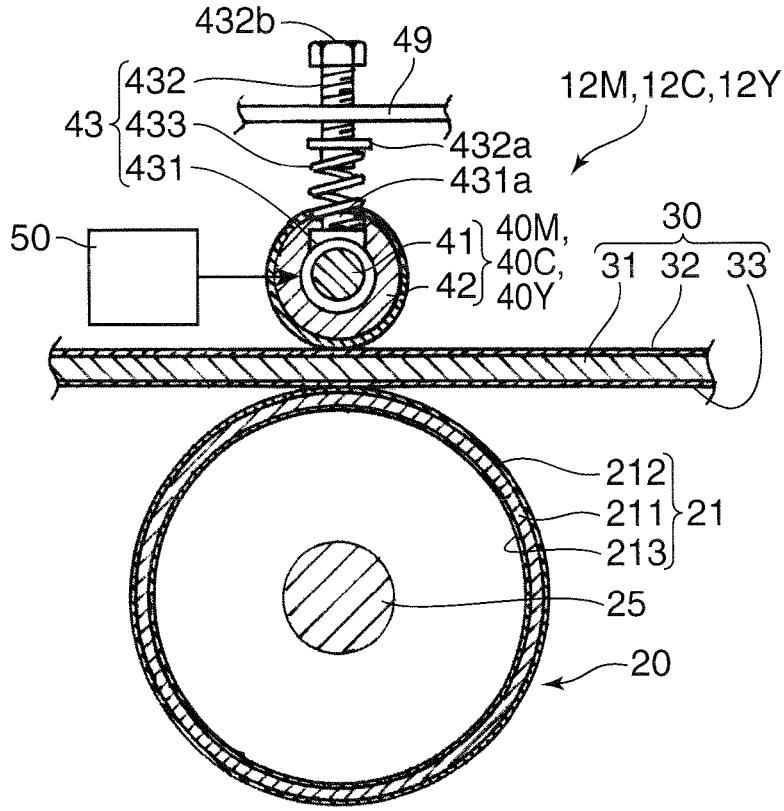
FIGS. 3A and 3B are front cross-sectional views schematically showing the photosensitive drum, an intermediate transferring belt and a primary transferring roller.
Figure 3B:
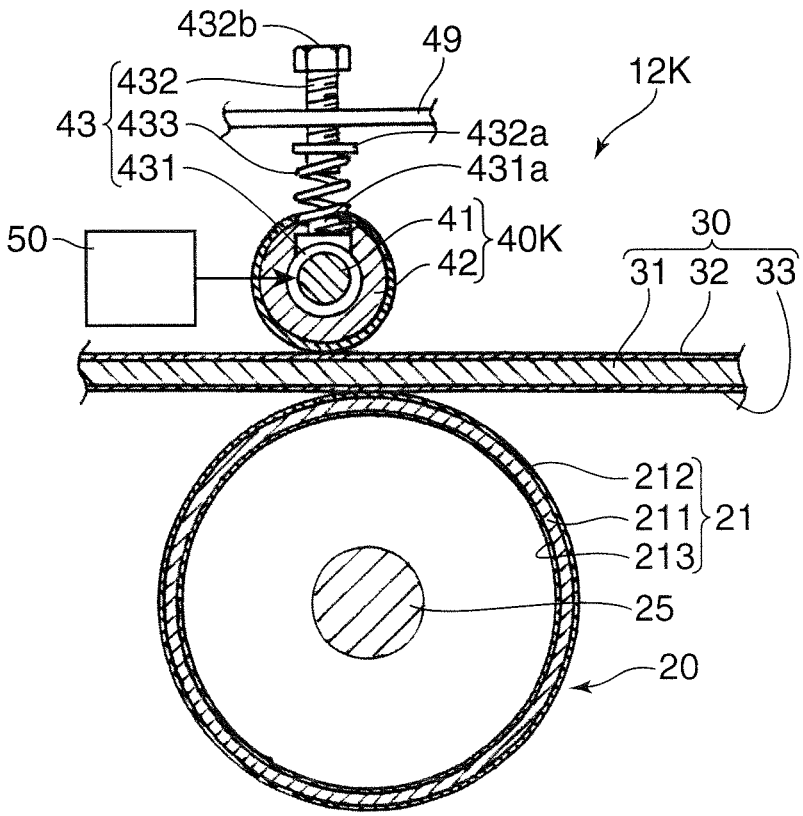

Hereinafter, the suppression of the toner dispersion in accordance with the present embodiment will be described with reference to FIGS. 3A, 3B and 4. FIGS. 3A and 3B are front sectional views schematically showing a positional relationship between the photosensitive drum 20, the intermediate transferring belt 30 and the primary transferring roller 40. FIG. 3A shows a positional relationship of those components for the units 12M, 12C and 12Y. FIG. 3B shows a positional relationship of those components for the black unit 12K. Further, FIG. 4 is a partial enlarged view of FIG. 1 and shows the photosensitive drums 20, the intermediate transferring belt 30 and the primary transferring rollers 40.

Figure 4:
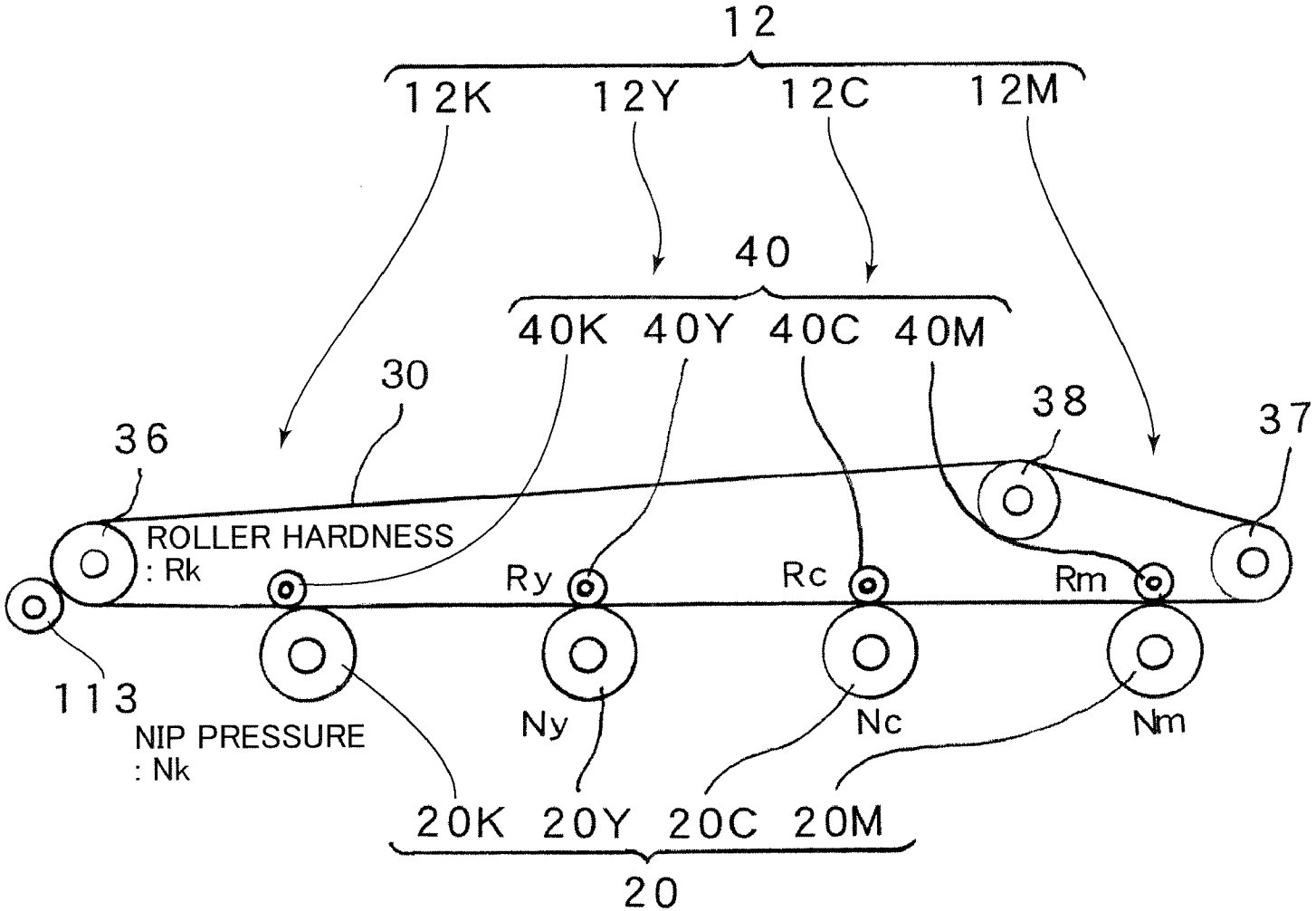
FIG. 4 is a partial enlarged view of FIG. 1 and shows the photosensitive drums, the intermediate transferring belt and the primary transferring roller.

In FIG. 4, on respective tail ends of the reference numerals of the photosensitive drums 20 and the primary transferring rollers 40, reference signs "M" indicating magenta, "C" indicating cyan, "Y" indicating yellow, and "K" indicating black are provided, so that it is clarified to which of the image forming units 12M, 12C, 12Y and 12K the photosensitive drum 20 and primary transferring rollers 40 belong.

Specifically, the reference numeral 20M indicates the photosensitive drum for magenta, and the reference numeral 20C indicates the photosensitive drum for cyan, and the reference numeral 20Y indicates the photosensitive drum for yellow, and the reference numeral 20K indicates the photosensitive drum for black. Further, the reference numeral 40M indicates the primary transferring roller for magenta, and the reference numeral 40C indicates the primary transferring roller for cyan, and the reference numeral 40Y indicates the primary transferring roller for yellow, and the reference numeral 40K indicates the primary transferring roller for black.

As shown in FIGS. 3A and 3B, the intermediate transferring belt 30 includes a sheet-like core sheet 31, a coating layer 32 formed on an upper surface of the core sheet 31, and a laminated film 33 laminated on a lower surface of the core sheet 31. The core sheet 31 is formed of an elastomer, such as a synthetic rubber and a flexible synthetic resin, having elasticity. Further, the coating layer 32 is formed by coating PTFE (polytetrafluoroethylene) which is a strong synthetic resin material. Further, the laminated film 33 is formed of a polyimide which is a strong synthetic resin material. The core sheet 31 is set to have a thickness of, for example, 250 μm. Further, each of the coating layer 32 and laminated film 33 is set to have a thickness of several μm to dozens of μm.

Since the intermediate transferring belt 30 is so configured as to have such three-layered structure, it can elastically deform as needed during rotation while securing the strength of the upper and lower surfaces, so as to respond to, for example, vibration during the rotation to absorb the vibration. Accordingly, the toner image is transferred appropriately from the peripheral surface of the photosensitive drum 20 to the surface (laminated film 33) of the intermediate transferring belt 30.

A volume resistivity pv of the intermediate transferring belt 30 is set to be $5*10^{10}$ Ωcm, and a surface resistivity ρs is set to be $1*10^{11}$ Ωcm.

The primary transferring roller 40 includes a roller shaft 41 made of metal and so arranged as to be parallel to the drum shaft 25 through the intermediate transferring belt 30, and a roller main body 42 externally fitted to the roller shaft 41 coaxially for integral rotation therewith.

In the present embodiment, the roller main body 42 is formed of a foam made from a mixture of epichlorohydrin ($C_3H_5ClO$) and NBR (acrylonitrile-butadiene copolymer rubber). The roller main body 42 is so set that its resistance value becomes $1*10^7$Ω when the voltage of 1000V is applied.

Such roller main body 42 of the primary transferring roller 40K for black has a maximum hardness Rk (in the present embodiment, a hardness of "Asker-C" is 35±5°), and the roller main bodies 42 of the primary transferring rollers 40M, 40C and 40Y for magenta, cyan and yellow have hardness Rm, Rc and Ry which are set to be equal to each other and lower than the hardness Rk of the primary transferring roller 40K for black. In other words, respective hardnesses of the roller main bodies 42 of the primary transferring rollers 40M, 40C, 40Y and 40K for magenta, cyan, yellow and black are set to satisfy the condition of "Rk>Rm=Rc=Ry".

By setting the hardnesses in such manner, the primary transferring roller 40K for black which is set to have a high contact pressure against the photosensitive drum 20K for black can be set to have the compression elastic deformation (i.e. nip amount) generally equal to those of the primary transferring rollers 40M, 40C and 40Y for magenta, cyan and yellow which are set to have low contact pressures against the photosensitive drums 20M, 20C and 20Y for magenta, cyan and yellow. Thus, the contact area between the primary transferring roller 40K and photosensitive drum 20K on the downstream-most side and the contact area between other primary transferring rollers 40M, 40C, and 40Y and the photosensitive drum 20 become substantially equal. As a result, transfer conditions become generally equal in the units 12M-12K, realizing a proper transfer from the photosensitive drums 20M, 20C, 20Y, and 20K for magenta, cyan, yellow, and black to the intermediate transferring belt 30.

The primary transferring roller 40 is pressed onto the peripheral surface of the drum main body 21 by a pressing mechanism 43 through the intermediate transferring belt 30. The pressing mechanism 43 includes a pair of bearing members 431 so externally fitted to the opposite ends of the roller shaft 41 to be in slide contact with the roller shaft 41, an adjustment screw 432 screwed to a predetermined frame 49 at a position above the bearing members 431 and extending in a vertical direction, and a coil spring 433 provided between the adjustment screw 432 and the bearing members 431.

Each of the bearing members 431 is provided with a cylindrical projection 431 projecting upward, and on the other hand, the adjustment screw 432 is provided with a flange 432*a* under the frame 49. The coil spring 433 is externally fitted at its lower end portion to the cylindrical projection 431*a* of the bearing member 431 and externally fitted at its upper end portion to the adjustment screw 432 at a position lower than the flange 432*a*. Accordingly, the coil spring 433 is provided between the bearing member 431 and the adjustment screw 432 in a compressed state.

In the pressing mechanism 43 so configured as described above, a head portion 432*b* of the adjustment screw 432 is rotated in clockwise and counter-clockwise directions about its axis, so that the pressing force of the primary transferring roller 40 with respect to the peripheral surface of the photosensitive drum 20 through the intermediate transferring belt 30, in other words, the contact pressure between the surface of the intermediate transferring belt 30 and the peripheral surface of the photosensitive drum 20 can be adjusted.

A power supply device 50 applies a bias, having a polarity which is opposite to that of the electric charge of the toner image formed on the peripheral surface of the photosensitive drum 20, to the roller main body 42 of the primary transferring roller 40 through the roller shaft 41. Accordingly, the toner image formed on the peripheral surface of the photosensitive drum 20 is peeled off electrically and transferred to the lower surface of the intermediate transferring belt 30.

In the present embodiment, the primary transferring rollers 40M, 40C and 40Y for magenta, cyan and yellow are, as shown in FIG. 3A, arranged at positions directly above the photosensitive drums 20 (in other words, arranged so that an axis of the roller shaft 41 is positioned on a vertical line passing through the axis of the drum shaft 25). On the other hand, the primary transferring roller 40K for black is, as shown in FIG. 3B, arranged at a position on a slightly downstream side (left side in the sheet of FIG. 3B) of the photosensitive drum 20 (in other words, a rotation center of the primary transferring roller 40K for black is positioned on a slightly downstream side of the rotation center of the photosensitive drum 20K for black).

Such positional setting is made on the following reason. The toner dispersion is not eye-catching when it occurs in the photosensitive drums 20M, 20C and 20Y facing the primary transferring rollers 40M, 40C and 40Y. On the other hand, the toner dispersion is so eye-catching and the image transferred to the intermediate transferring belt 30 is so contaminated when the toner dispersion occurs in the photosensitive drum 20K for black facing the primary transferring roller 40K on the downstream-most side. Therefore, the primary transferring roller 40K for black is positioned slightly downstream of the photosensitive drum 20K rather than immediately above the photosensitive drum 20K.

The toner dispersion is reduced by arranging the primary transferring roller 40K for black slightly downstream of the photosensitive drum 20K for black. The reason is as follows. It is proven by experiment that in the case where the primary transferring roller 40 is arranged at a position directly above the photosensitive drum 20, the electric discharge which occurs between the intermediate transferring belt 30 and the photosensitive drum 20 by the application of the bias from the power supply device 50 to the primary transferring roller 40 is stronger on the downstream side (left side in FIG. 3) of the contact position between the intermediate transferring belt 30 and the photosensitive drum 20 than the upstream side.

When the electric discharge occurs, the toner dispersion which causes fine particles of toners constituting the toner image is induced by the electric discharge and becomes likely to occur. To prevent the toner dispersion, the primary transferring roller 40K for black is moved to the slightly downstream position with respect to the position directly above the photosensitive drum 20K for black. It is also proven by experiment that such arrangement makes the electric discharge to be unlikely to occur.

In the present embodiment, the primary transferring roller 40K for black is displaced to be at a position slightly downstream of a normal position (a position of an axis of the photosensitive drum 20). The amount of displacement is set to be any amount. In the present embodiment, it is set to be 1.5 mm.

Further, in the present embodiment, when it is given that a contact pressure of the intermediate transferring belt 30 with respect to the photosensitive drum 20K in the black unit 12K on the downstream-most side is identified with Nk, and contact pressures of the intermediate transferring belt 30 with respect to the magenta, cyan and yellow photosensitive drums 20M, 20C and 20Y in the magenta, cyan and yellow units 12M, 12C and 12Y are identified with Nm, Nc and Ny respectively, the relationship therebetween is expressed with Nk>Nm=Nc=Ny. In the present embodiment, the contact pressures Nm, Nc and Ny of the intermediate transferring belt 30 with respect to the magenta, cyan and yellow photosensitive drums 20M, 20C and 20Y are set to be 260 g/cm$^2$. On the other hand, the contact pressure Nk of the intermediate transferring belt 30 with respect to the black photosensitive drum 20K is set to be 560 g/cm$^2$, which is more than double the contact pressures in other units.

The contact pressures are set as described above, so that the surface of the intermediate transferring belt 30 in the black unit 12K comes in press contact with the peripheral surface of the black photosensitive drum 20K at the contact pressure Nk which is higher than the normal contact pressures Nm, Nc and Ny. Accordingly, the toner image on the peripheral surface of the black photosensitive drum 20K is pressed more strongly onto the surface of the intermediate transferring belt 30. Therefore, a part of the intermediate transferring belt 30 in contact with the black photosensitive drum 20K has a surface that is compressed and elastically deformed more than normal to cover the peripheral surface of the black photosensitive drum 20K in a wider area thereof. As a result, fine particles of black toners of the toner image formed on the peripheral surface of the black photosensitive drum 20K is prevented from dispersing, so that the toner dispersion of the black toners can be prevented effectively.

On the other hand, in the magenta, cyan and yellow units 12M, 12C and 12Y, the contact pressures Nm, Nc and Ny with respect to the magenta, cyan, and yellow photosensitive drums 20M, 20C and 20Y are set to be normal values which are lower than Nk on the following reasons. Specifically, even if the toner dispersion occurs in magenta, cyan and yellow toners, it is not so eye-catching. Accordingly, it is not necessary to increase the contact pressures Nm, Nc and Ny, which will consume great amount of energy for rotation of the intermediate transferring belt 30.

As described above in detail, the image forming apparatus 10 in accordance with the present embodiment includes a plurality of photosensitive drums 20 so arranged as to form on their respective peripheral surfaces toner images of toners having different colors, an intermediate transferring belt 30 onto which the toner images on the photosensitive drums 20 are transferred sequentially in superimposition, primary transferring rollers 40 for sandwiching the intermediate transferring belt 30 with the photosensitive drums 20 to electrically peel the toner images off the photosensitive drums 20 to transfer the same onto the intermediate transferring belt 30.

According to the configuration above, the intermediate transferring belt 30 is rotated in synchronization with the transferring processing of the photosensitive drums 20, so that the toner images retained by the photosensitive drums 20 are transferred onto the intermediate transferring belt 30 sequentially from an upstream side to a downstream side in superimposition. Accordingly, a color image is formed on the intermediate transferring belt 30 at the time when the transfer processing of the toner image of the photosensitive drum 20 on the downstream-most side is completed.

Then, the photosensitive drum 20 on the downstream-most side among the plurality of photosensitive drums 20 and from which the toner image is transferred onto the intermediate transferring belt 30 at the last is so provided that the contact pressure with respect to the intermediate transferring belt 30 becomes higher than contact pressures of other photosensitive drums 20 with respect to the intermediate transferring belt 30. Accordingly, this high contact pressure prevents the fine particles of toners, constituting the toner image on the downstream-most side photosensitive drum 20, from dispersing. As a result, it can effectively prevent toner dispersion which causes adherence of the toner particles dispersed around the toner image to the intermediate transferring belt 30.

Especially, in the present embodiment, the black unit 12K is provided on the downstream-most side, and black toners are used in the black photosensitive drum 20K in the black unit 12K. Accordingly, contamination of the color image due to dispersion of black toner particles of the toner image on the black photosensitive drum 20K on the downstream-most side to the toner images of different colors superimposed can be prevented. As a result, an appropriate color image having no toner dispersion can be formed on the intermediate transferring belt 30.

Further, the magenta, cyan and yellow photosensitive drums 20M, 20C and 20Y other than the black photosensitive drums 20K on the downstream-most side have equal contact pressures with respect to the intermediate transferring belt 30. Accordingly, the contact pressures can be easily set, so that operability in assembling the image forming apparatus 10 can be improved, and an energy cost for rotating the intermediate transferring belt 30 can be suppressed.

Since the black unit 12K is set on the downstream-most side and the black photosensitive drum 20K is provided therein, black toners are superimposed for outlining characters and images at the last in a state where a color toner image is formed with other color toners, so that a clear and fine color image can be formed.

Further, the contact pressure of the downstream-most side black photosensitive drum 20K against the intermediate transferring belt 30 is set to be equal to or higher than 560 g/cm$^2$ which is more than double the contact pressures of the magenta, cyan and yellow photosensitive drum 20M, 20C and 20Y, so that the toner dispersion can be prevented effectively. By the way, that the toner dispersion is reduced by setting the contact pressure to be equal to or higher than 560 g/cm$^2$ was found by conducting experiments for many times.

Further, the black primary transferring roller 40K for the black photosensitive drum 20K faces the black photosensitive drum 20K through the intermediate transferring belt 30 at a position where the rotation center of the black primary transferring roller 40K is displaced slightly downstream of the rotation center of the black photosensitive drum 20K. Accordingly, as compared to the configuration in which the primary transferring roller 40 is arranged at a position directly above the photosensitive drum 20, electric discharge which is likely to occur on the downstream side of a position where the black primary transferring roller 40K and the black photosensitive drum 20K face to each other can be prevented from occurring. As a result, toner dispersion which is likely to be induced by the electric discharge can be prevented effectively.

Further, in the present embodiment, the intermediate transferring belt 30 is provided which extends and rotates between at least two rollers (the driving roller 36 and the driven roller 37). Accordingly, after a color image is once formed on the surface of the intermediate transferring belt 30, the color image is transferred to a sheet P supplied separately so that a color printing is performed with respect to the sheet P. As described above, the transferring processing is performed with respect to the sheet P not directly but once through the intermediate transferring belt 30, the processing of superimposing the toners of different colors can be performed easily and assuredly, so that the color printing with respect to the sheet P can be performed appropriately.

The present invention is not limited to the embodiment described above, but may include the following.

(1) In the embodiment described above, the image forming apparatus 10 is described as a printer. However, the image forming apparatus 10 may be a copying machine, a facsimile machine, or the like.

(2) In the embodiment described above, the primary transferring processing is applied to the intermediate transferring belt 30. However, the primary transferring processing can may be applied directly to the sheet P supplied from the sheet storage section 14, alternatively. In this case, in place of the intermediate transferring belt 30, a conveying belt may be provided which conveys the sheet P along the magenta, cyan, yellow and black units 12M, 12C, 12Y and 12K, so that the primary transferring processing is performed in the respective units 12M, 12C, 12Y and 12K with respect to the sheet P which is conveyed by the conveying belt. According to this feature, the secondary transfer performed by the secondary transferring roller 113 becomes unnecessary, so that it can contribute to reduction of the cost for the apparatus.

(3) In the embodiment described above, only the primary transferring roller 40K of the black unit 12K is provided at a position slightly downstream of the position directly above the photosensitive drum 20. However, the primary transferring rollers 40M, 40C and 40Y of the magenta, cyan and yellow units 12M, 12C and 12Y may also be arranged at a position slightly downstream of the position directly above the photosensitive drum 20. In this way, toner dispersion can be prevented also in the magenta, cyan and yellow units 12M, 12C and 12Y.

(4) In the embodiment described above, the contact pressure Nk of the downstream-most side black photosensitive drum 20K of the black unit 12K against the intermediate transferring belt 30 is set to be higher than a normal value, and the respective contact pressures Nm, Nc, and Ny of the magenta, cyan and yellow photosensitive drums 20M, 20C and 20Y against the intermediate transferring belt 30 are set to be the normal value and be equal to each other. Instead of setting in such a way, the contact pressures may be set so as to be higher gradually from the unit on the upstream side to the unit on the downstream side. For example, the contact pressure Nm of the upstream-most side magenta photosensitive drum 20M with respect to the intermediate transferring belt 30 may be set to be 130 g/cm$^2$, and the contact pressure Nc of the cyan photosensitive drum 20C with respect to the intermediate transferring belt 30 may be set to be 270 g/cm$^2$, and the contact pressure Ny of the yellow photosensitive drum 20Y with respect to the intermediate transferring belt 30 may be set to be 410 g/cm$^2$, and the contact pressure Nk of the black photosensitive drum 20K with respect to the intermediate transferring belt 30 may be set to be 560 g/cm$^2$. Setting the contact pressures in such a way may make the toner dispersion be not eye-catching by sequential superimposition.

In this case, it is preferable that the hardness Rk of the black primary transferring roller 40K is set to be maximum and the hardness Rm, Rc, and Ry of the magenta, cyan and yellow primary transferring rollers 40M, 40C and 40Y are set so as to be proportional to the contact pressures N (in other words, set so as to satisfy Rk>Ry>Rc>Rm). Setting the hardnesses in such way makes it possible to uniform elastic deformation of the magenta, yellow, cyan and black primary transferring rollers 40M, 40C, 40Y and 40K which are in press contact with the magenta, yellow, cyan and black photosensitive drums 20M, 20C, 20Y and 20K through the intermediate transferring belt 30. Accordingly, the transferring processing can be applied from the magenta, cyan, yellow and black photosensitive drums 20M, 20C, 20Y and 20K to the intermediate transferring belt 30 under the same condition. As a result, more preferable color image can be formed on the intermediate transferring belt 30.

(5) In the embodiment described above, the primary transferring roller 40 is pressed by the pressing mechanism 43 whose pressure can be adjusted by rotating the adjustment screw 432 about its axis. However, once the pressure force is set, it is less likely to be adjusted. Accordingly, the pressing mechanism 43 whose pressure force can be adjusted may be omitted.

EXAMPLE

For the purpose of confirming that the toner dispersion becomes less likely to occur if the contact pressure between the photosensitive drum 20 and the intermediate transferring belt 30 are made greater than normal, an experiment for confirming the effect is conducted with use of the image forming apparatus shown in FIG. 1.

In this experiment, letters were outputted by a monochromatic printing only with black toners in the black unit 12K without performing the color printing to perform a printing processing to the sheet P.

Further, as an example, the strength of the coil spring 433 of the primary transferring roller 40K of the black unit 12K was adjusted so that the contact pressure of the intermediate transferring belt 30 with respect to the photosensitive drum 20K was set to be 560 g/cm$^2$. In this state, a bias was applied to the primary transferring roller 40 at −10 μA, and an image forming processing was performed to print the letters on the sheet P.

On the other hand, as a comparative example, the strength of the coil spring 433 of the primary transferring roller 40K of the black unit 12K was adjusted so that the contact pressure of the intermediate transferring belt 30 with respect to the photosensitive drum 20K was set to be 260 g/cm$^2$. In this state, a bias was applied to the primary transferring roller 40K at −10 μA, and the image forming processing was performed to print the letters on the sheet.

Figure 5A:
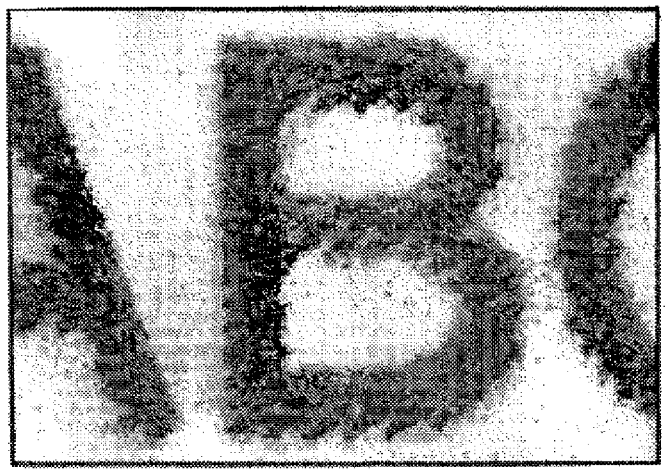
FIGS. 5A and 5B are magnified photographs showing printing results of an example and a comparative example.
Figure 5B:
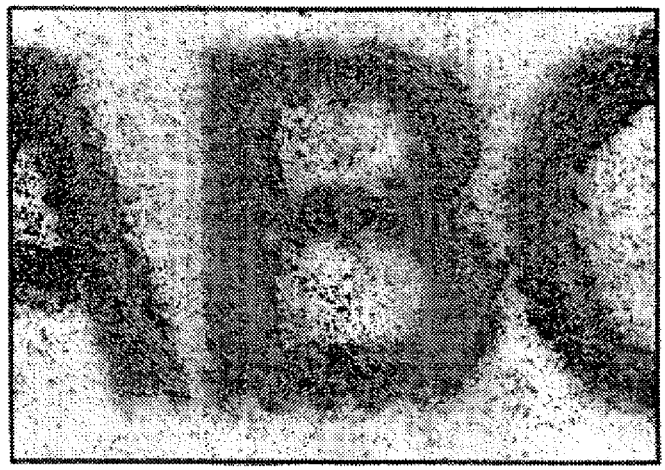

FIGS. 5A and 5B show magnified photographs showing printing results of the example and the comparative example. FIG. 5A shows the example, and FIG. 5B shows the comparative example.

In the case of the example, as shown in FIG. 5A, a contour of the letters with respect to the surface of the sheet was clear, and dispersion of toner fine particles, which is so-called toner dispersion, could not be confirmed and it can be seen that a clear printing processing was performed.

On the other hand, in the case of the comparative example, as shown in FIG. 5B, lots of traces of dispersed toners formed by the toner dispersion on the surface of the sheet were seen, and it can be seen that this made the contour of the letters be unclear.

As described above, it is proven that setting the contact pressure of the intermediate transferring belt 30 with respect to the photosensitive drum 20 to be greater than normal can suppress the toner dispersion on the printed image.

The image forming apparatus in accordance with the present embodiment described above includes the following configurations.

An image forming apparatus in accordance with the present embodiment includes a plurality of image bearing members having respective peripheral surfaces and arranged sequentially so that toner images of toners having different colors are formed on the peripheral surfaces, respectively, an endless belt having a surface and so rotated that the toner images formed on the image bearing members are sequentially transferred to the surface or a sheet conveyed on the surface, a plurality of transferring members for sandwiching the endless belt with the corresponding image bearing members to transfer the toner images formed on the image bearing members to the surface of the endless belt or the sheet. The image bearing member on the downstream-most side among the plurality of image bearing members and from which the toner image is last transferred to the surface of the endless belt or the sheet is so arranged that a contact pressure of the downstream-most side image bearing member against the endless belt becomes higher than contact pressures of the other image bearing members against the endless belt.

According to this configuration, the endless belt is so moved as to be in synchronization with the transfer processing of each image bearing member, so that a plurality of toner images carried by the image bearing members are transferred to the endless belt from the upstream to the downstream sequentially, and a color image is formed on the endless belt at the time of completion of transferring the toner image onto the downstream-most side image bearing member.

Then, since the contact pressure of the downstream-most side image bearing member with respect to the endless belt is so set as to be higher than the contact pressures of the other image bearing members with respect to the endless belt, the higher contact pressure prevents fine particles of toners, constituting the toner image, from dispersing to the periphery. Accordingly, the toner dispersion causing the dispersed toner particles in the periphery of the toner image on the endless belt can be prevented.

In the configuration above, it is preferable that the image bearing members other than the downstream-most side image bearing member are so arranged that the contact pressures are set to become higher sequentially towards the downstream-most side image bearing member. According to this configuration, as it goes from the image bearing member on the upstream-most side to the image bearing member on the downstream-most side, the degree of toner dispersion reduces sequentially, so that the toner dispersion becomes less eye-catching.

In the configuration above, it is preferable that the image bearing members other than the downstream-most side image bearing member are so arranged as to have the contact pressures equal to each other. According to this configuration, the contact pressures of the image bearing members other than the downstream-most side image bearing member with respect to the endless belt are so set as to be equal to each other, so that it becomes easy to set the contact pressures and thereby improves operability in assembling the image forming apparatus.

In the configuration above, it is preferable that the image bearing member on the downstream-most side is an image bearing member on which a toner image of black toners is formed. When the toner dispersion occurs in black toners, the toner dispersion becomes so eye-catching. However, according to the configuration above, the image bearing member on which the black toner image is formed is so set as to have a high contact pressure with respect to the endless belt, so that the toner dispersion of black toners becomes less eye-catching.

In the configuration above, it is preferable that the transferring member corresponding to the downstream-most side image bearing member is so arranged as to have hardness higher than hardness of each of the other transferring members. According to this configuration, since the hardness of the transferring member corresponding to the downstream-most side image bearing member having a high contact pressure is so set as to be higher than that of the other transferring members corresponding to the other image bearing members having low contact pressures, the compression elastic deformation (in other words, amount of nip) of the transferring member on the downstream-most side and the compression elastic deformation of the other transferring member can be made substantially equal. Thus, a contact area of the transferring member on the downstream-most side with respect to the corresponding image bearing member and contact areas of the other transferring members with respect to the corresponding image bearing members becomes substantially equal. As a result, an appropriate transferring processing from the respective image bearing members to the endless belt can be realized.

In the configuration above, it is preferable that the image bearing members are rotated about their respective first rotational axes, and the transferring members are rotated about their respective second rotational axes and also preferable that each transferring member faces the corresponding image bearing member through the endless belt at such a position where a rotation center of the transferring member is slightly downstream of a rotation center of the corresponding image bearing member. According to this configuration, each transferring member is so arranged as to face the corresponding image bearing member through the endless belt while being displaced to a position slightly downstream with respect to the corresponding image bearing member. Accordingly, the electric charge which is likely to occur on the downstream side of the position where the transferring member and the image bearing member face can be suppressed. As a result, the toner dispersion which is likely to be induced by the electric discharge can be suppressed.

In the configuration above, it is preferable that the image bearing members are rotated about their respective first rotational axes, and the transferring members are rotated about their respective second rotational axes and also preferable that the transferring member corresponding to the image bearing member on which the black toner image is formed faces such image bearing member through the endless belt at such a position where a rotation center of the transferring member is slightly downstream of a rotation center of the image bearing member. According to this configuration, the toner dispersion of black toner which is eye-catching can be suppressed.

In the configuration above, it is preferable that hardness of each of the transferring members is so set as to become higher sequentially towards the transferring member corresponding to the downstream-most side image bearing member. According to this configuration, elastic deformation of each transferring member in press contact with the corresponding image bearing member through the endless belt may be set to be substantially equal. Thus, the transferring processing can be applied from each image bearing member to the endless belt under the same condition. As a result, more favorable color image can be formed on the endless belt.

This application is based on Japanese Patent Application No. 2007-152881 filed in Japan Patent Office on Jun. 8, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a plurality of image bearing members having respective peripheral surfaces and arranged sequentially so that toner images of toners having different colors are formed on the peripheral surfaces, respectively;

an endless belt having a surface and so rotated that the toner images formed on the image bearing members are sequentially transferred to the surface or a sheet conveyed on the surface;

a plurality of transferring members for sandwiching the endless belt with the corresponding image bearing members to transfer the toner images formed on the image bearing members to the surface of the endless belt or the sheet; and wherein the image bearing member on the downstream-most side among the plurality of image bearing members and from which the toner image is last transferred to the surface of the endless belt or the sheet is so arranged that a contact pressure of the downstream-most side image bearing member against the endless belt becomes higher than contact pressures of the other image bearing members against the endless belt.

2. The image forming apparatus according to claim 1, wherein the image bearing members other than the downstream-most side image bearing member are so arranged that the contact pressures are set to become higher sequentially towards the downstream-most side image bearing member.

3. The image forming apparatus according to claim 1, wherein the image bearing members other than the downstream-most side image bearing member are so arranged as to have the contact pressures equal to each other.

4. The image forming apparatus according to claim 1, wherein the downstream-most side image bearing member is an image bearing member on which a toner image of black toners is formed.

5. The image forming apparatus according to claim 1, wherein the transferring member corresponding to the downstream-most side image bearing member is so arranged as to have hardness higher than hardness of each of the other transferring members.

6. The image forming apparatus according to claim 1, wherein the image bearing members are rotated about their respective first rotational axes, and the transferring members are rotated about their respective second rotational axes; and wherein each transferring member faces the corresponding image bearing member through the endless belt at such a position where a rotation center of the transferring member is slightly downstream of a rotation center of the corresponding image bearing member.

7. The image forming apparatus according to claim 4, wherein the image bearing members are rotated about their respective first rotational axes, and the transferring members are rotated about their respective second rotational axes; and wherein the transferring member corresponding to the image bearing member on which the black toner image is formed faces such image bearing member through the endless belt at such a position where a rotation center of the transferring member is slightly downstream of a rotation center of the image bearing member.

8. The image forming apparatus according to claim 2, wherein hardness of each of the transferring members is so set as to become higher sequentially towards the transferring member corresponding to the downstream-most side image bearing member.

* * * * *